US006491533B2

(12) United States Patent
Costello et al.

(10) Patent No.: US 6,491,533 B2
(45) Date of Patent: Dec. 10, 2002

(54) SWITCHING CONNECTOR HEADER AND AUDIO CIRCUIT, SOUND CARD AND METHOD EMPLOYING SAME

(75) Inventors: Thomas M. Costello, Havertown, PA (US); John G. DeHelian, Red Hill, PA (US)

(73) Assignee: Creative Technology Ltd. (SG)

( * ) Notice: Subject to any disclaimer, the term of this patent is extended or adjusted under 35 U.S.C. 154(b) by 83 days.

(21) Appl. No.: 09/736,633

(22) Filed: Dec. 14, 2000

(65) Prior Publication Data

US 2002/0076961 A1 Jun. 20, 2002

(51) Int. Cl.[7] ..... H01R 29/00
(52) U.S. Cl. ..... 439/188; 381/123
(58) Field of Search ..... 439/61, 188; 361/279, 361/801, 826, 686; 211/41.47; 381/123; 700/94

(56) References Cited

U.S. PATENT DOCUMENTS 4,035,587 A 7/1977 Undhjem et al. ..... 179/98
4,139,744 A * 2/1979 Pypno ..... 179/167
4,217,624 A 8/1980 Tuck ..... 361/394
4,949,384 A * 8/1990 Noro et al. ..... 381/96
5,666,267 A * 9/1997 Carter et al. ..... 361/686
5,788,509 A * 8/1998 Byers et al. ..... 439/61
6,099,334 A 8/2000 Togashi ..... 439/188
6,219,732 B1 * 4/2001 Henrie et al. ..... 395/283

* cited by examiner

*Primary Examiner*—Brian Sircus
*Assistant Examiner*—J. F. Duverne
(74) *Attorney, Agent, or Firm*—Woodcock Washburn LLP

(57) ABSTRACT

A sound card and related method includes a sound processing circuit, a rear primary connector, and a switching connector header coupled therebetween. The switching header includes a normally closed spring contact that opens in response to insertion of a plug in the header. Upon opening of the connector header switches, the audio signal is received by a secondary connector coupled to the plug and disposed at the front of a computer. The secondary connector has a normally closed switch that enables the signal to pass back to the header and to the primary connector. Each of the primary connector and secondary connector may be automuting to interrupt the audio signal at a main output contact in response to insertion of a headphone or other jack therein. The sound card is operational either with or without the secondary connector.

21 Claims, 8 Drawing Sheets

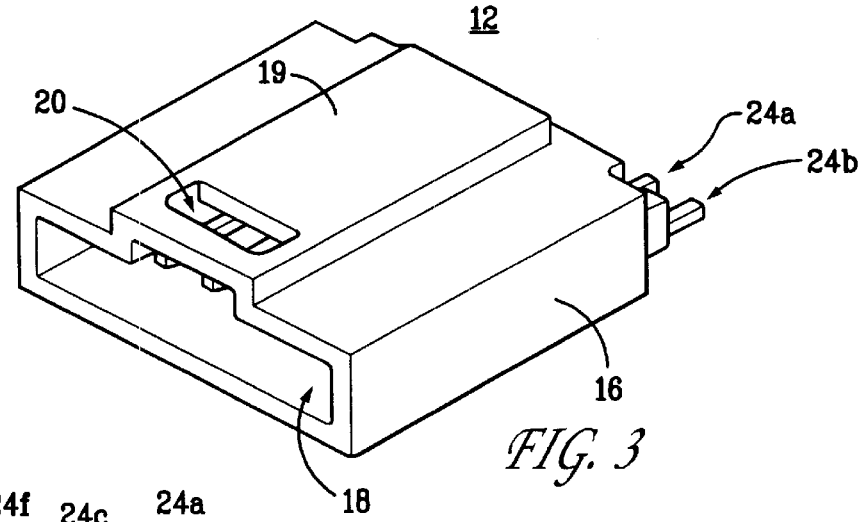
FIG. 3
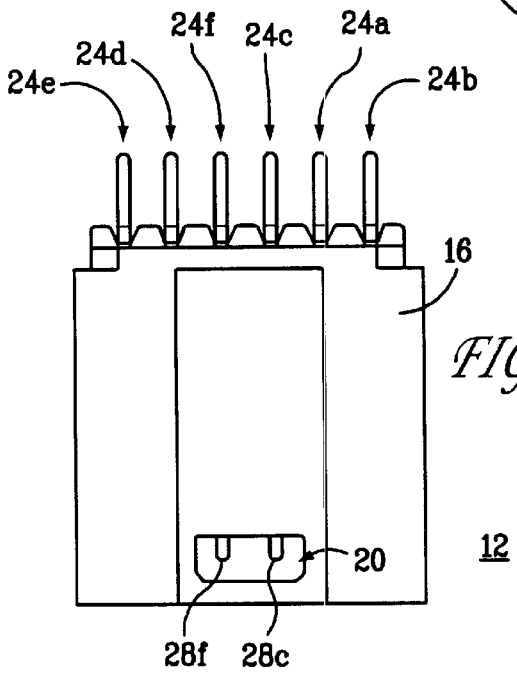
FIG. 4A
FIG. 4B
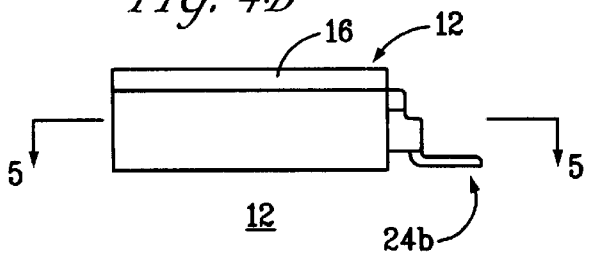
FIG. 4C
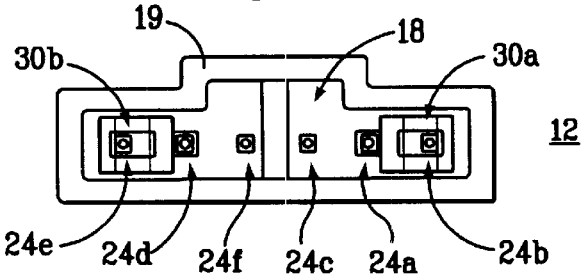

SWITCHING CONNECTOR HEADER AND AUDIO CIRCUIT, SOUND CARD AND METHOD EMPLOYING SAME

FIELD OF THE INVENTION

This invention relates to computer and electronic components and, more particularly, to sound card circuit configurations and related components for generating or processing audio signals, and, even more particularly, to a switching header connector and systems for generating or processing audio signals employing same.

BACKGROUND

Sound cards are add-on boards that are employed within a personal computer or related device to produce or process audio signals for enhancing sound quality, or for enabling sound capabilities, of the computer. Sound cards may, for example, produce or enhance a sound representing a prompt or other sound from an ordinary computer program, sounds for video games played on the computer, and downloadable music or sounds such as, for example, in an MPEG Audio Layer standard. Conventional sound cards may also be capable of capturing and processing signals from musical instruments.

The circuitry of a conventional sound card may include audio subsystems for digital audio capture and replay, as well as music synthesis, by, for example an internal FM synthesizer and playing a digitized or sampled sound. A matched pair of digital-to-analogue (DAC) and analogue-to-digital (ADC) converters coupled with a programmable sample rate generator may be provided to process digital audio.

In addition to an interface with the computer bus, sound cards typically provide an interface to a player that is capable of playing music and/or video, such as compact discs and digital video disks, which will be referred to herein as CD-ROMS. They also support proprietary interfaces for the CD-ROM player, as well as standard interfaces such as SCSI and IDE/EIDE standards. Thus, a sound card may process signals from CD-ROMS or other play-back equipment, downloaded or stored files (including telephone answering machine files), musical instruments, and the like.

Several connectors may be part of a sound card to provide digital or analog connections thereto. Such connectors include one or more microphone in connector(s), line in and line out connector(s), loudspeaker out connector(s), musical instrument digital interface ("midi") port(s), joystick port, mpc-3 CD audio in or similar connector(s), auxiliary in connector(s), telephone answering device in connector(s), digital out connector(s), optical or coaxial digital I/O card connector(s), headphone outs connector(s), and the like.

Some of the connectors may be accessible from outside of the computer. Specifically, the headphone connector or headphone jack typically protrudes through or is accessible through an aperture in the sound card bracket, which encloses the expansion slot. The sound card circuitry may be configured such that the audio signal to the loudspeaker output connector(s) is muted in response to inserting a headphone plug into the headphone connector. In such a configuration in which the audio signal is audible through loudspeakers electrically connected to the loudspeaker output connector, plugging the headphone plug into the headphone connector stops the sound emitted from the loudspeakers in favor of providing the audio signal to the headphones.

Some computer manufacturers have placed a headphone jack at a location that is convenient to the user, such as the computer front panel. To connect it to the audio signal, the front headphone jack may be connected to the sound card. However, merely connecting the front headphone jack in parallel with the rear headphone jack would make it difficult to mute the audio signal in response to insertion of the front headphone connector into the front headphone jack. In this regard, although a general purpose input/output device may be employed to sense insertion of a headphone connector into the front headphone jack to mute the rear headphone jack—either through the card software or through an additional analog switch—such a configuration requires the use of additional op-amps and switches or custom sound card software, which increases cost and complexity of the sound card.

On the other hand, connecting the front headphone jack to a normally-open front connector on the sound card in series with the primary connector has the disadvantage that the signal must be transmitted to the front of the computer and back to the sound card during operation with the rear headphone jack or the loudspeakers. Further, because not all computer manufacturers employ a front headphone jack in addition to the rear headphone jack, sound card manufacturers must produce two versions of the same sound card. Computer manufacturers and sound card re-sellers and retailers likewise must keep two versions of each sound card in stock—one for use with computers employing only a single (that is, rear) headphone jack and another for use with computers having both a rear and front headphone connector. Similar problems are presented for a card having a microphone input connector in circumstances in which a second or front microphone connector is optionally provided and is to be spaced apart from the card.

SUMMARY

A switching connector header and a sound card and related method that employ the connector header are provided. The switching features of the connector header enable the sound card to operate in both a first configuration and a second configuration. The first configuration includes a sound source (such as a sound processing circuit) the connector header, and a primary connector (such as a headphone jack disposed at a rear of a computer). An audio signal from the sound source passes through a normally-closed switch in the connector header to the primary connector and optionally to a main audio output contact. The second configuration includes, in addition to the components of the first configuration, a secondary connector, such as a headphone jack disposed at a front of the computer, having a wiring harness and a plug. Upon insertion of the wiring harness plug into the connector header, the header switches open to provide the audio signal to the secondary connector and optionally also to the primary connector.

The connector header according to a first aspect of the present invention is provided comprising: a housing including a plug opening disposed therein; a first pin and a second pin, such that at least a portion of each one of the first pin and the second pin are at least partially disposed within the housing; and a spring contact that is mechanically coupled to the first pin and moveable between a closed position and an open position. In the closed position, the spring contact engages the second pin to electrically couple the first pin and the second pin together. In the open position, the spring contact is disengaged with the second pin. The spring contact moves from the closed position to the open position in response to insertion of a plug into the plug opening.

According to a second aspect of the present invention, an audio circuit and corresponding sound card are provided that include a main audio system and a secondary system, which may be remotely located relative to the main audio system. The main audio system may be operative alone (that is, without the secondary system) or with the secondary system connected to the main audio system. In this regard, the audio circuit and corresponding sound card are provided comprising a sound source for manipulating or receiving an audio signal, a primary connector electrically coupled to the sound source, a switching header comprising a first contact electrically coupled to the sound source output, a second contact electrically coupled to the primary connector, and a header switch between the header first contact and the header second contact.

The audio circuit optionally includes an auto-muting, secondary connector circuit (which constitutes the secondary system) that may comprise: a secondary circuit first contact that is electrically coupled to the header first contact; a secondary circuit second contact that is electrically coupled to the header second contact; and a secondary connector switch that is electrically coupled between the secondary circuit first contact and the secondary circuit second contact. The secondary connector switch is capable of muting the audio signal at the header second contact.

The header switch moves from a closed position to an open position between the header first contact and the header second contact in response to coupling of the secondary circuit to the header. The header switch is in the closed position between the header first contact and the header second contact while the secondary circuit is not coupled to the header to enable the audio signal to pass therethrough to the primary connector circuit. In this regard, the audio circuit and sound card provided are operable in either a first configuration (that is, without the secondary circuit coupled thereto) or a second configuration (that is, with the secondary circuit coupled thereto). The primary connector may include a primary switch that opens to mute the audio signal to the main output contact in response to insertion of a primary plug into the primary connector. The audio circuit and sound card may employ one or more channels.

According to another aspect of the present invention, a method is provided for optionally coupling a secondary connector to a sound card that is operable for processing an audio signal either without the secondary connector or with the secondary connector coupled thereto. The method comprises the steps of providing a sound card for processing an audio signal and, optionally, plugging a secondary connector into a switching connector header of the sound card. The header has at least two electrically spaced-apart contacts and a header switch disposed therein. A first one of the header contacts receives the audio signal, and a second one of the header contacts electrically is coupled to the primary connector. The header switch is closed between the header first contact and the header second contact to enable the audio signal to pass therethrough to a primary connector disposed on the sound card. The header switch opens between the header first contact and the header second contact to mute the audio signal at the primary connector.

Additional features and aspects of the present invention will be apparent to persons familiar with sound card and/or header technology in light of the present disclosure.

BRIEF DESCRIPTION OF THE DRAWINGS

FIG. 3 is a perspective view of the connector header portion of the header assembly shown in FIG. 1;

FIG. 4A is a top view of the connector header portion shown in FIG. 3;

FIG. 4B is a side view of the connector header portion shown in FIG. 3;

FIG. 4C is an end view of the connector header portion shown in FIG. 3;

DESCRIPTION OF PREFERRED EMBODIMENTS

Figure 10A:
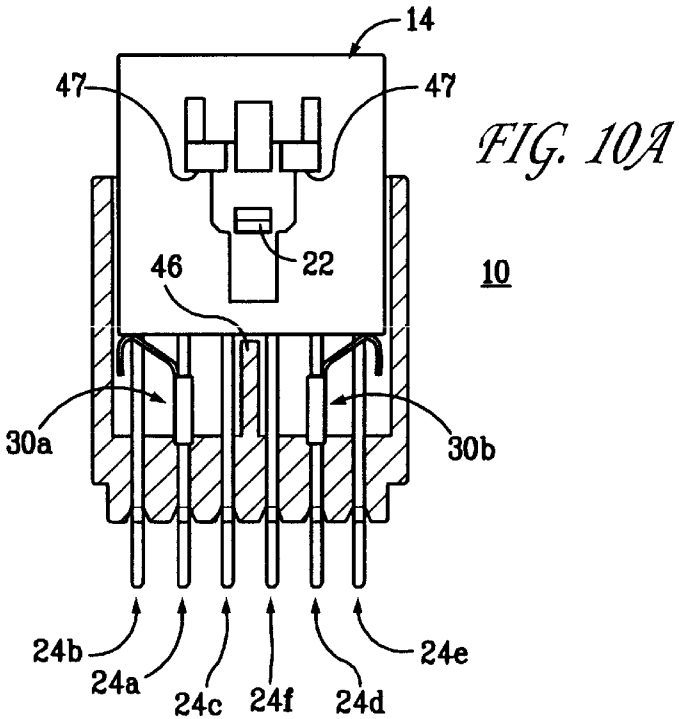
FIG. 10A is a top view of the connector header assembly shown in FIG. 9.
Figure 10C:
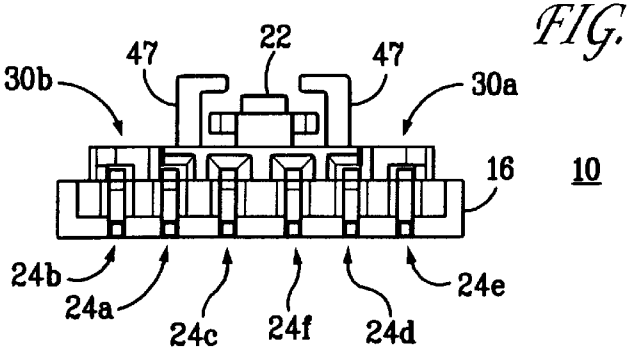
FIG. 10C is an end view of the connector header assembly shown in FIG. 9.

FIGS. 1 through 10A, 10B, and 10C illustrate a first aspect of the present invention in which a switching connector header assembly 10 is provided that includes a connector header 12 and a plug 14. The assembly is shown in a perspective view in FIG. 1; in top, side, and end views in FIGS. 2A, 2B, and 2C, respectively; in an enlarged perspective view with a portion of the housing removed to illustrate internal portions of header assembly 10 in FIG. 9 (including spring contacts and pins); and in top, side, and end views (of the view of FIG. 9) in FIGS. 10A, 10B, and 10C, respectively.

Header 12, which is illustrated apart from plug 14 in FIGS. 3, 4A, 4B, 4C, 5, 6A, and 6B, includes a housing 16 that forms a plug opening 18 in an end thereof Housing 16 preferably is rectangular to provide opening 18 with a substantially rectangular shape. Other shapes that are capable of mating with the plug 14 (shown in FIGS. 9, 10A, 10B, and 10C) are encompassed by the present invention, regardless of the shape of the plug 14.

Housing 16 and opening 18 may include an additional, protruding portion 19 for receiving a corresponding protruding portion of plug 14 so as to form a conventional latch. Protruding portion 19 makes housing 16 asymmetric so as to prevent insertion of plug 14 in an improper orientation. A top portion of protruding portion 19 includes a spring latch aperture 20 formed therein for receiving a spring member 22 of plug 14. As best-shown in FIGS. 5, 6A, and 6B, header housing 16 also has a stop 46 disposed therein that protrudes from the back sidewall (that is, opposite of opening 18) of housing 16.

Figure 5:
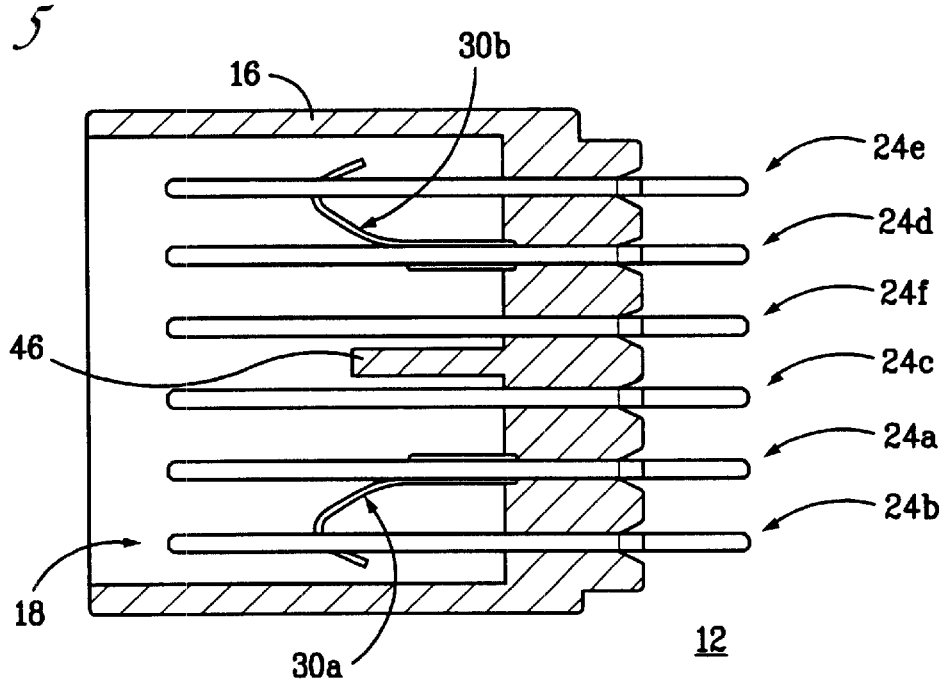
FIG. 5 is a sectional view of the connector header portion taken along lines 5—5 in FIG. 4B.
Figure 6A:
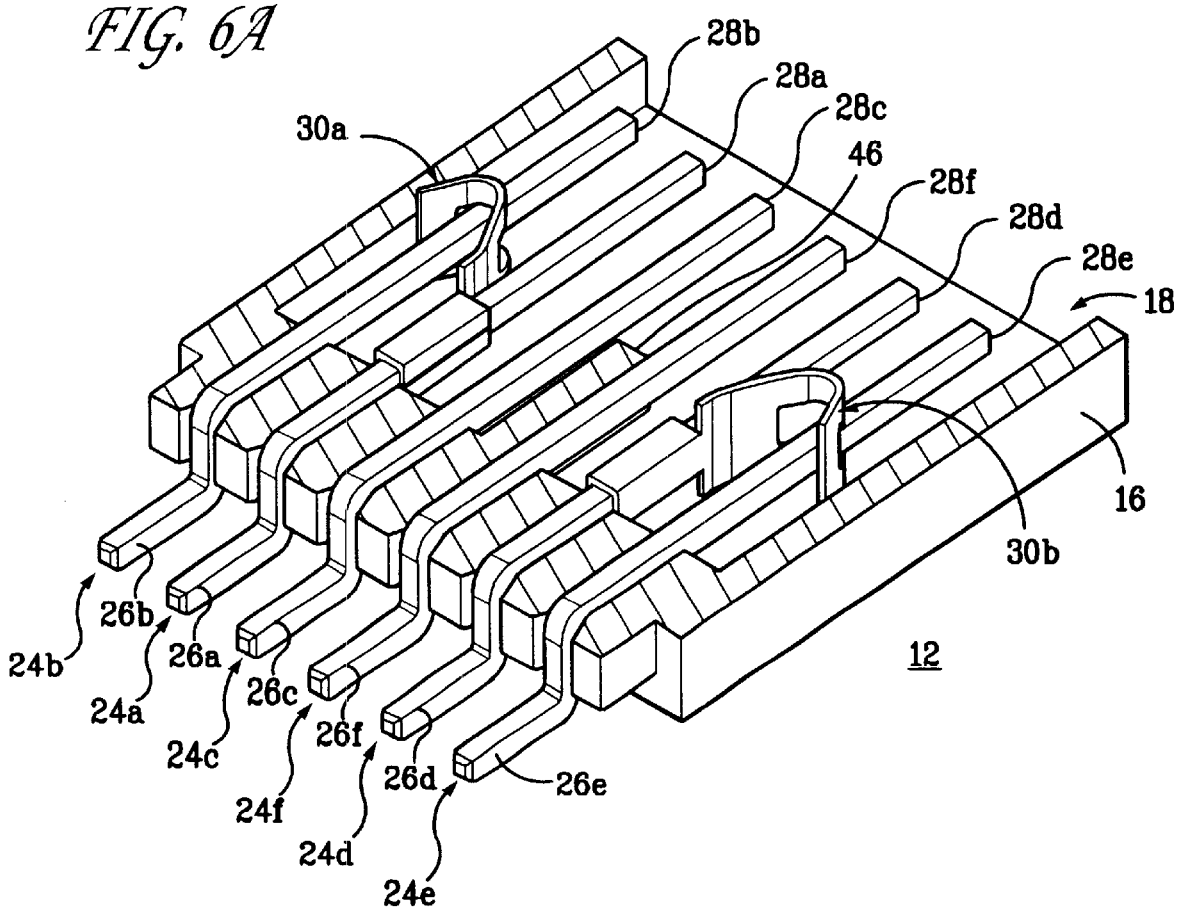
FIG. 6A is an enlarged sectional, perspective view of the connector header portion shown in FIG. 3, showing the housing of the connector header cut away.
Figure 6B:
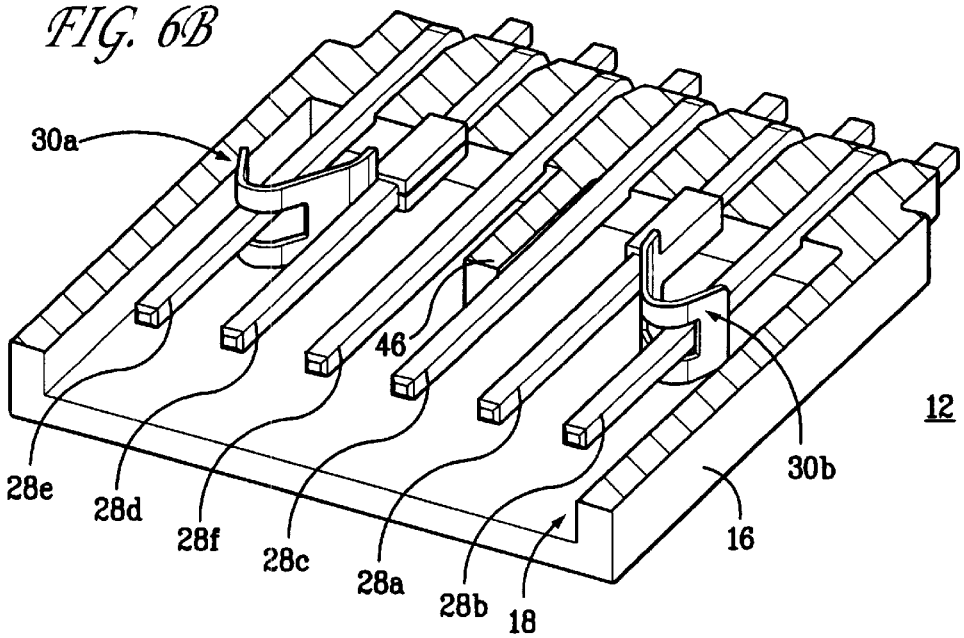
FIG. 6B is another enlarged sectional, perspective view of the connector header portion shown in FIG. 3, showing the housing of the connector header cut away.
Figure 7:
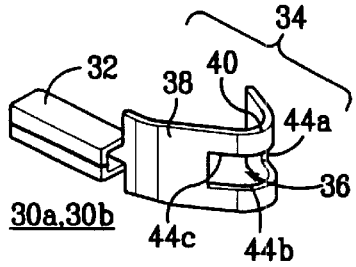
FIG. 7 is a perspective view of the spring contact portion of the header assembly shown in FIGS. 6A and 6B.
Figure 8A:
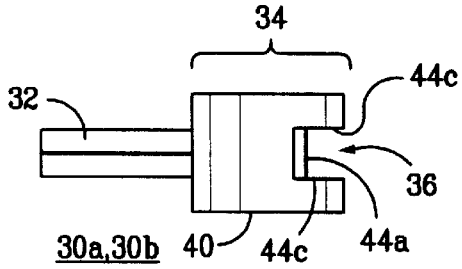
FIG. 8A is a first side view of the spring contact portion shown in FIG. 7.
Figure 8B:
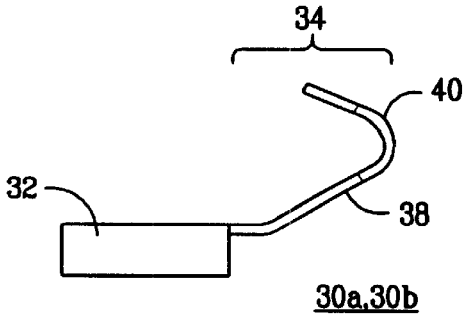
FIG. 8B is an end view of the spring contact portion shown in FIG. 7.
Figure 8C:
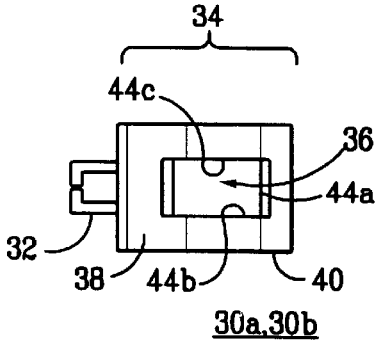
FIG. 8C is a top view of the spring contact portion shown in FIG. 7 that is taken orthogonal to the view of FIG. 8A.

Plural pins and at least one spring contact are disposed within the housing 16. The description of the pins herein employs a letter designation after the reference numeral 24 to identify particular pins. In this regard, as shown in FIGS. 5, 6A, and 6B, the plural pins include a pair of first pins 24*a* and 24*d*, a pair of second pins 24*b* and 24*e*, and a pair of third pins 24*c* and 24*f*, each of which are oriented mutually parallel within housing 16. Each of the pins 24*a* through 24*f* is electrically isolated from each of the other pins within housing 16.

Preferably, each one of the pins 24*a–f* is identical to each other pin, and therefore portions of the following description employ the designation "pin 24" as illustrative of each of the pins 24*a–f*. In this regard, pin 24 includes a body 28 and, preferably, a tail 26 that is roughly parallel to the long axis of the body 28 and offset therefrom to enable a surface mount connection. Body 28 extends through the back wall of housing 16 opposite opening 18 into the cavity formed within housing 18. Body 28 has a bend formed therein that extends downwardly to couple with tail 26. Such a configuration of the body and tail are for illustrative purposes and the invention encompasses any shape to enable any mounting configuration (for example, a through hole configuration), as will be apparent to persons familiar with mounting technology.

As best shown in FIGS. 6A and 6B, each pin 24 preferably has a substantially square shape in transverse cross section. At least one spring contact is disposed within housing 16 to electrically couple two of the pins together in a first spring contact position, and to interrupt the electrical coupling therebetween in a second spring contact position. To illustrate spring contacts that may perform the switching function, a pair of spring contacts 30*a* and 30*b* is provided, as best shown in FIGS. 5 through 10 (including each figure designated by a letter).

As shown in FIGS. 7, 8A, 8B, and 8C, each spring contact 30*a* and 30*b* includes a contact clip 32 and an extending portion 34 in which a window 36 is formed. Preferably, each contact 30*a* and 30*b* is formed by sheet metal stamping and bending techniques. However, the present invention encompasses any suitable spring material that would provide the electrical contact and would provide the operative mechanical (spring) properties, such as beryllium, copper, and the like.

Each contact clip 32 preferably is an elongate tubular member having an opening therein or therethrough for receiving a pin 24—particularly first pins 24*a* and 24*d*. In this regard, the opening in clip 32 preferably has a square shape in transverse cross section to match that of the pins. The present invention also encompasses other cross sectional shapes of the pins 24 and contact clips 32 that enable mating therebetween, including rectangular, round, elliptical or oval, and other cross sectional shapes in transverse cross section.

The extending portions 34 of each spring contact 30*a* and 30*b* extend outwardly from clip portion 32. As best shown in FIGS. 7, 8A, 8B, and 8C, each extending portion 34 extends obliquely from an end of clip portion 32, and includes a substantially straight or planar portion 38. A curved portion 40 extends from a distal end (that is, distal relative to clip 32) of straight portion 38. A window 36 is formed through each spring contact 30*a* and 30*b*, preferably near the peak of curved portion 40. Preferably, the window 36 is formed by a distal end portion or end wall 44*a*, opposing sides 44*b* and 44*c* that are coupled to distal end portion 44*a*, and a proximal end wall. As explained more fully below, preferably, opposing sides 44*b* and 44*c* and the proximal end wall are spaced apart from the pin that extends through window 36 both while the switch is in the closed position and in the open position (that is, both while the spring contact is in contact with the pin projecting therethrough and while it is spaced apart therefrom, respectively).

FIGS. 5 through 8 (including each of the Figures appended with a letter designation) illustrate the configuration of spring contacts 30*a* and 30*b* with pins 24 in which the contact clip 32 of each spring contact 30*a* and 30*b* is coupled to a pin body 28. Specifically, the contact clip 32 of first spring contact 30*a* is securely disposed around the body of first pin 24*a*. Similarly, the contact clip 32 of the second spring contact 30*b* is securely disposed around the body of the other first pin 24*d*. Such contact between contact clip 32 and pin body 28 may be a press fit or interference fit to form an electrical connection therebetween. Extending portion 34 extends toward an adjacent pin, which extends through window 36. Specifically, extending portion 34 of first spring contact 30*a* extends toward second pin 24*b*, which extends through the window 36 thereof Likewise, extending portion 34 of extending spring contact 30*b* extends toward the other second pin 24*e*, which extends through the window 36 thereof.

In the embodiment shown herein, the spring contacts 30*a* and 30*b*, first pins 24*a* and 24*d*, and second pins 24*b* and 24*e* respectively constitute normally closed switches. In this regard, spring contacts 30*a* and 30*b* are urged against (that is, in spring contact with) second pins 24*b* and 24*e*, respectively, so as to form a closed circuit between pins 24*a* and 24*b*, and between pins 24*d* and 24*e*. Preferably, the extending portion 34 is urged toward the longitudinal centerline of the clip 32 by the spring action of the spring member such that first spring contact 30*a* is urged clockwise and second spring contact 30*b* is urged counter-clockwise as oriented in FIG. 5. End walls 44*a* and 44*b* of first and second contact springs 30*a* and 30*b* are therefore urged against the outboard sides of second pins 24*b* and 24*e*, respectively. Sides 44*b* and 44*c* are not in contact with the pins to enable extending portion 34 to freely move relative to its corresponding pin. The spring action of the spring contacts 30*a* and 30*b* may be obtained by urging the spring contacts from their rest state upon assembly of the spring contacts onto the pins 24 within housing 16.

Header 12 is illustrated as having six pins 24*a* through 2*f*, although the present invention encompasses any number of pins of at least two to enable the switching function of the header, as will be understood by person familiar with conventional headers, switches, and/or circuits in light of the present disclosure. A particularly useful embodiment may employ five or six pins to provide switching between two pairs of pins (that is, first and second pins 24*a* and 24*b* form the poles of a first switch and first and second pins 24*d* and 24*e* form the poles of a second switch), a ground connection, and, in the case of a six pin header, an extra pin that may optionally be employed according to the requirements of the circuit.

Figure 9:
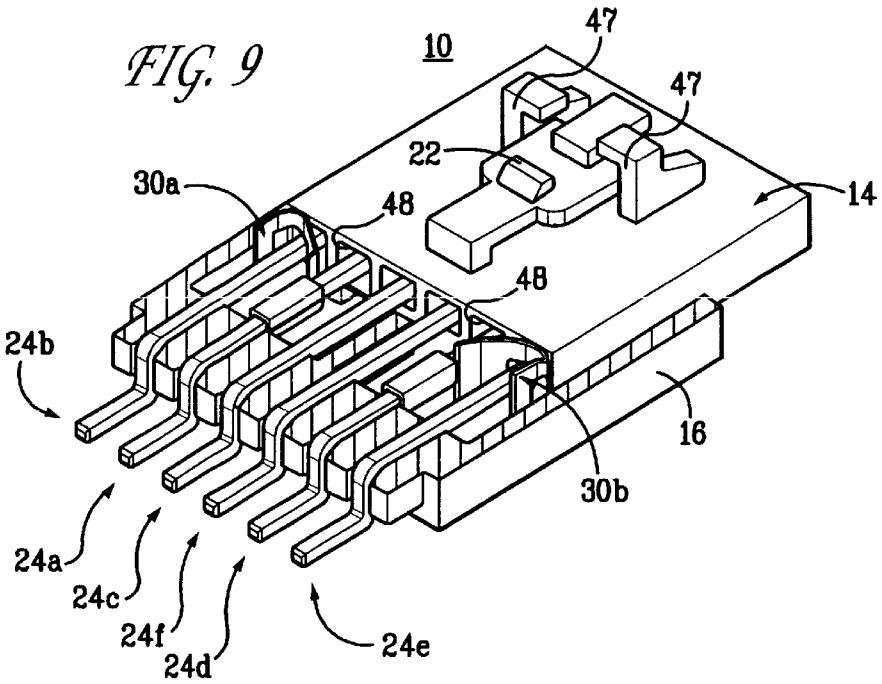
FIG. 9 is perspective view of the connector header assembly shown in FIG. 1 with a portion of the housing of the connector header portion removed for clarity.
Figure 10B:
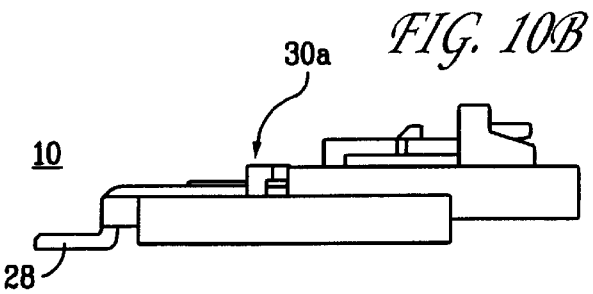
FIG. 10B is a side view of the connector header assembly shown in FIG. 9.

Plug 14 may be any plug that mates with the shape of header 12. Plug 14 includes plug receptacles 48, as shown in FIG. 9, that receive the pins 24 upon insertion of plug 14 into header 12, which thereby electrically couples each of the pins 24 to its corresponding receptacle 48. Plug 14 also includes a device for electrically coupling plug 14 to other another component of the circuit in which header assembly 10 is employed, such as ribbon connector 50 (shown in FIGS. 1 and 2B), discrete wire (not shown in the Figures), and the like. A spring member 22 is disposed on the top of plug 14 for releasably engaging spring latch aperture 20 so as to secure plug 14 and header 12 together upon plug 14 being fully inserted into header housing 16. A pair of stops 47 is disposed on opposing sides of spring member 22. As will be apparent to persons familiar with connector technology, the present invention encompasses employing any conventional latching mechanism.

FIGS. 9, 10A, 10B, and 10C illustrate an open position of the contacts or switches in which plug 14 is inserted into opening 18. A front portion of plug 14 contacts the distal portion of spring contact curved portion 40 and urges extending portion 34 backward until distal walls 44*a* of first and second spring contacts 30*a* and 30*b* are spaced apart from second pins 24*b* and 24*d*, respectively. Plug 14 may be urged into header housing 16 until the leading edge of plug 14 contacts housing stop 46 and/or plug stops 47 contact the edge of housing 16 to establish the plug fully inserted position.

In the fully inserted position, the distal end wall 44*a* and the proximal wall opposing it are spaced apart from its respective second pin, and sides 44*b* and 44*c* are also spaced apart therefrom, thereby interrupting the electrical connection between the spring contact 30*a* (or 30*b*) and the second pin 24*b* (or 24*e*) that projects through window 36. Thus, the electrical connection between the first and second pins 24*a* and 24*b* (or 24*d* and 24*e*) is interrupted. Upon removal of plug 14 from header 12, the spring action of the contacts enables extending portion 34 of spring contact 30*a* (or 30*b*) to return to their normal (that is, un-actuated) position so as to close the electrical connection between pins 24*a* and 24*b* and between pins 24*d* and 24*e*.

Figure 11:
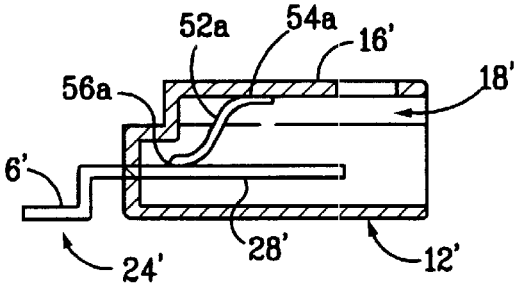
FIG. 11 is a cut away view of another embodiment of the connector header according to the present invention.
Figure 12A:
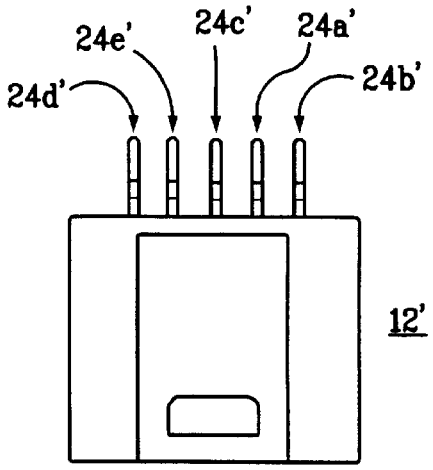
FIG. 12A is a top view of the connector header shown in FIG. 11.
Figure 12B:
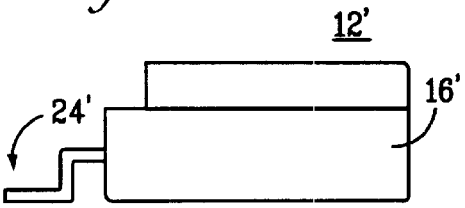
FIG. 12B is a side view of the connector header shown in FIG. 1.
Figure 12C:
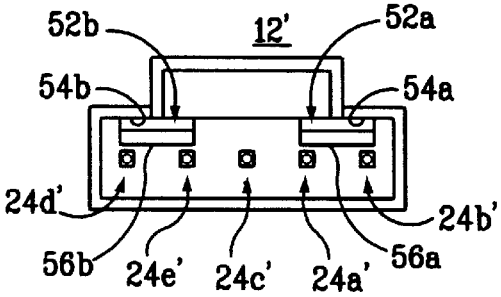
FIG. 12C is an end view of the connector header shown in FIG. 11.
Figure 13:
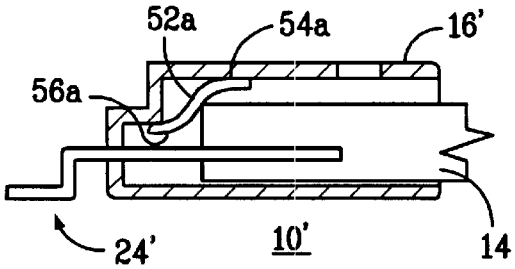
FIG. 13 is a sectional view of a connector header assembly including the connector header shown in FIG. 11.

FIGS. 11 and 12A, 12B, 12C, and 13 illustrate a second embodiment of the present aspect of the invention in which header assembly 10' includes a connector header 12' and a plug 14 (shown in FIG. 13). Housing 16' and pins 24' are substantially as described above with respect to the first embodiment. A pair of spring contacts 52*a* and 52*b* is disposed within housing 16'. As employed above, the letter designations "a" and "b" are employed after a reference numeral to indicate first and second elements, and the corresponding reference numeral without the letter designation refers generally to any of the particular elements.

Spring contacts 52*a* and 52*b* are substantially flat and S shaped. The spring contacts 52*a* and 52*b* are cantilevered from an interior surface of housing 16', as best shown in FIGS. 11 and 12C. A fixed end 54*a* and 54*b* of each spring contact may be coupled or anchored to the top portion of housing 16' by any conventional means, such as rivets of metal or plastic (not shown), gluing, and the like. Contact ends 56*a* and 56*b* are disposed opposite fixed ends 54*a* and 54*b*, respectively, and are urged against pins 24 by the spring action of the spring contacts 52*a* and 52*b*. First spring contact 52*a* simultaneously is urged against and in contact with first and second pins 24*a'* and 24*b'*, and second spring contact 52*b* is urged against and in contact with first and second pins 24*d'* and 24*e'*, thereby forming electrical connections therebetween. Thus, pins 24*a'* and 24*b'* and spring contact 52*a* form a first normally closed switch, and pins 24*d'* and 24*e'* and spring contact 52*b* form a second normally closed switch, within header connector 12'.

FIG. 13 illustrates the open position of the contacts or switches in which the leading edge of plug 14 contacts a portion of each of the spring contacts 52*a* and 52*b* so as to urge them backwardly and out of contact with its respective pins 24*a'* and 24*b'* and pins 24*d'* and 24*e'*, thereby interrupting the electrical connections therebetween. Upon removal of plug 14 from connector header 12', the spring action of the spring contacts 52*a* and 52*b* enables re-contact with the pins and, thus, closes the electrical connections between pins 24*a'* and 24*b'* and pins 24*d'* and 24*e'*.

First header assembly 10 is illustrated with a six pin header 12 while second header assembly 10' is illustrated with a five pin header 12'. Similar to as described with respect to the first embodiment, the first and second pins for the first spring contacts 52*a* and 52*b* represent the first four pins 24*a'*, 24*b'*, 24*d'*, and 24*e'*. The fifth pin 24*c'* preferably is for providing a ground contact, as will be understood by persons familiar with electronic circuits. The sixth contact (not shown) of the second embodiment is optional, and may be included according to the particular application into which the present is employed.

According to a second aspect of the present invention, a sound card 60 is provided that employs a switching header 112, such as connector headers 10 and 10'. Sound card 60 is operable in each one of a first configuration and a second configuration. The first configuration generally includes circuitry for processing an audio signal, a primary connector for receiving a primary headphone plug, and the switching connector header. The second configuration includes the elements of the first configuration and also a wiring harness that is capable of being inserted into the connector header and a secondary connector for receiving a secondary plug.

Figure 14:
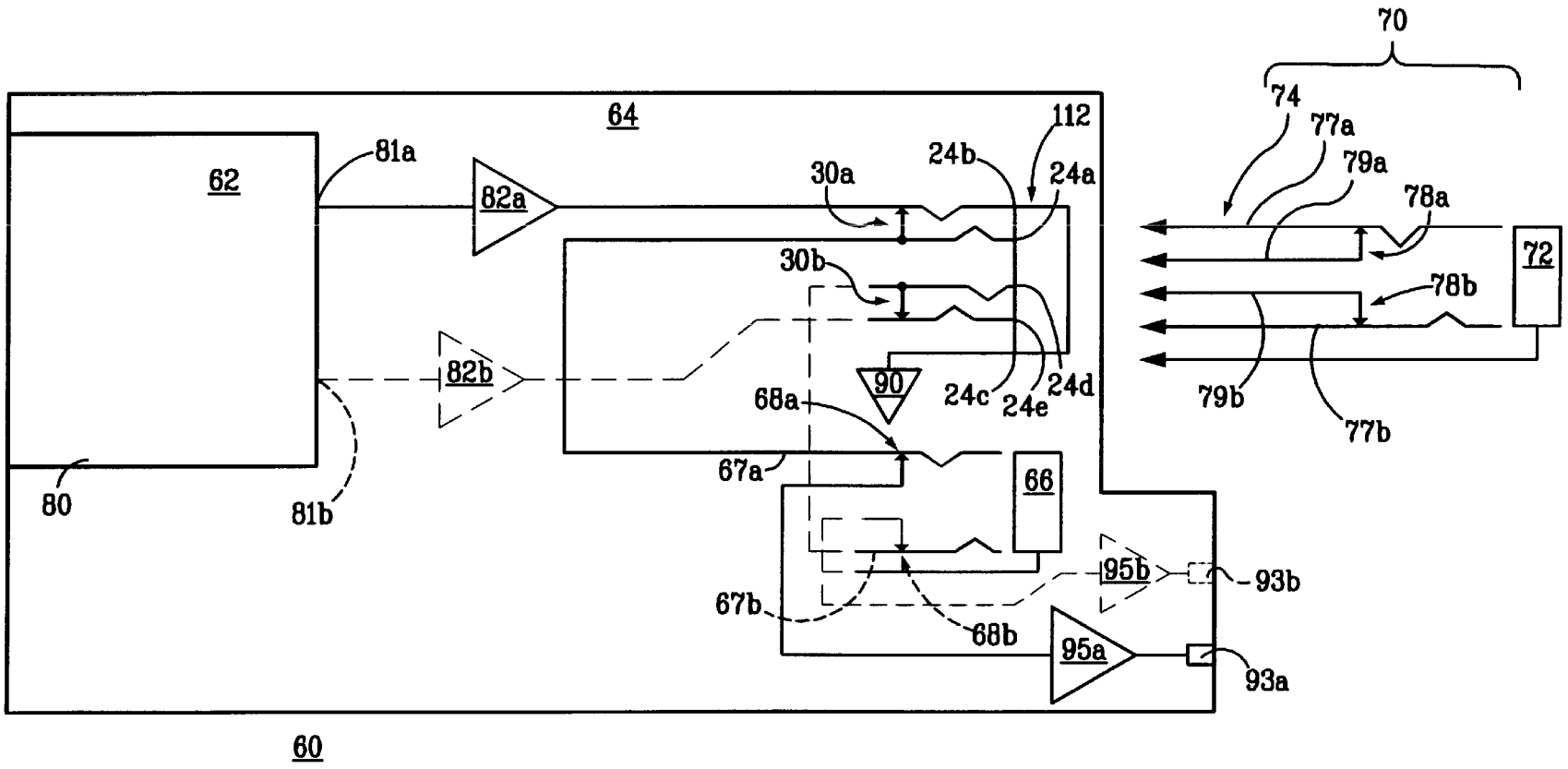
FIG. 14 is a schematic view of an audio circuit according to a second aspect of the present invention.

As shown in FIG. 14, the sound card system 60, and the corresponding audio circuit, includes a sound processing circuit 62 and related components for producing an audio signal, a printed circuit board (PCB) 64, a primary connector 66, a switching connector header 112, and, optionally, a secondary connector assembly 70, which includes a secondary connector 72 and a wiring harness 74. The configuration essentially comprising the processing circuit 62, primary connector 66, and switching connector header 112, and which omits the secondary connector assembly 70, is referred to herein as the first configuration. The configuration that comprises the elements of the first configuration as well as the secondary connector 72 and wiring harness 74 is referred to herein as the second configuration.

Figure 15:
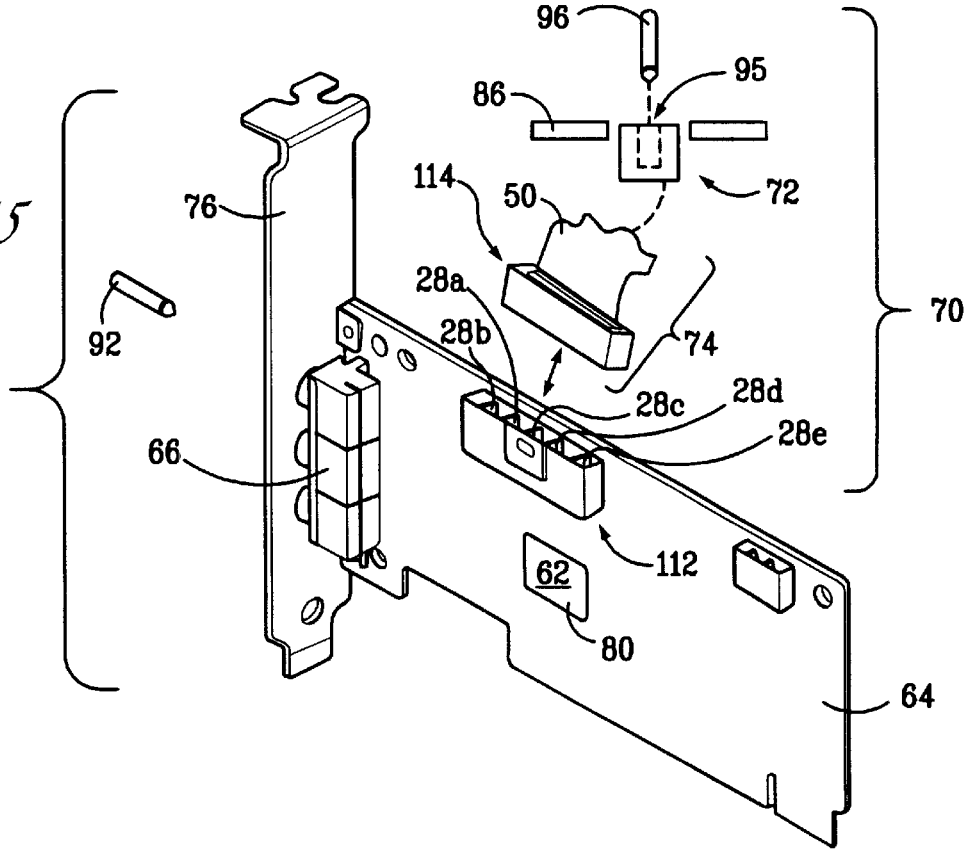
FIG. 15 is a perspective view of a sound card according the second aspect of the present invention.
Figure 16:
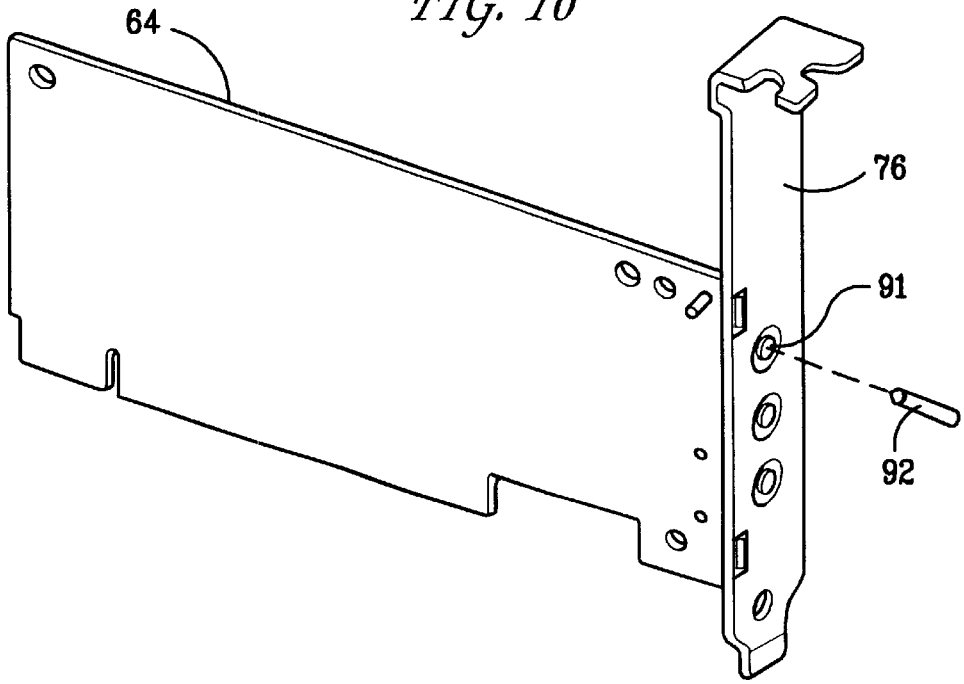
FIG. 16 is a rear perspective view of the sound card shown in FIG. 15.

PCB 64 is shown in FIGS. 15 and 16 as a half-height add-on board for a personal computer, although the present invention encompasses boards of any geometry employed in any computing device. PCB 64 is mounted on to bracket 76 that may cover the computer expansion slot (not shown), which typically is disposed at the rear of a personal computer box. Other common features of a printed circuit board, such as, for example, conventional male and female connectors, signal lines, and the like, are omitted from FIGS. 15 and 16 for clarity. Although components of the present invention are described as mechanically affixed (that is directly mounted via conventional methods, such as for example surface mounting) on PCB 64, the present invention encompasses configurations in which some of the components (in addition to secondary connector 72) are not disposed on the PCB 64.

The sound processing circuit 62 employs conventional circuitry to generally process any audio signal, such as (for example) a signal in compliance with SoundBlaster (TM) and general MIDI standards. A coder/decoder module 80 illustrates a portion of the sound processing circuit. Codec 80 includes a pair of outputs 81*a* and 81*b*. Codec 80 is mounted to the printed circuit board 64 by any conventional method, such as surface mounting. The dashed lines in FIG. 14, with which the latter output 81*b* is shown, indicate that the components shown thereby are optional, and may be omitted according to the particular configuration in which the present invention may be employed.

The present invention is illustrated by describing the sound processing circuit with particular reference only to one op-amp at each output 81*a*, 81*b* of codec 80, although the present invention encompasses a sound processing circuit of any type and/or configuration. In this regard, the embodiment described herein may employ additional operational amplifiers, resistors, and components (not shown) that may be encompassed within a sound processing circuit of a sound card. Further, the term "sound source" is employed herein to encompass any sound processing circuit and the like that may be coupled to or formed on the PCB, as well as a signal that is provided via a connector to the PCB. Referring again to the figures, op-amps 82*a* and 82*b* are mounted onto PCB 64 and electrically connected to the outputs 81*a* and 81*b*, respectively, of codec 80. Resistors (not shown) and additional components may optionally be mounted onto PCB 64 and electrically coupled to the output sides of op-amps 82*a* and 82*b*, as required for the particular circuit.

Primary connector 66 includes a first contact 67*a* for receiving the audio signal, and a switch 68*a*. Primary connector 66 may include a second contact 67*b* and a second switch 68*b*, as shown schematically in FIG. 14 in dashed lines to indicate that they are optional components. First contact 67*a* is coupled to connector header first pin 24*a*, and second contact 67*b* is coupled to the other first pin 24*d*. Preferably, connector header 112 is oriented on PCB 64 such that primary connector contacts 67*a* and 67*b* are coupled to the tail ends 26 of the pins 24. FIG. 14 shows pins 24*a* through 24*e* in different relative positions compared with those shown in FIGS. 1 through 13—such as pin 24*c* being disposed on the outboard-most side of connector header 112 and second pin 24*e* being disposed relatively outboard of first pin 24*d*—to more easily illustrate the connections therewith. In this regard, the present invention encompasses any configuration of pins 24*a* through 24*e* and/or spring contacts 30*a* and 30*b* (or 52*a* and 52*b*) within housing 16 (or housing 16').

As shown in FIGS. 15 and 16, which provide front and rear perspective views of the assembled components, primary connector 66 includes a primary socket 91 formed therein for receiving a primary plug 92. Primary connector 66 preferably is mounted to PCB 64 and protrudes through mounting bracket 76 so as to provide access to primary socket 91. Switches 68*a* and 68*b* provide an auto-muting function to primary connector 66 such that insertion of primary plug 92 into primary socket 91 opens switches 68*a* and 68*b*. The circuit to a pair of main output contacts 93*a* and 93*b*, respectively, is thereby interrupted to mute the audio signal to main output contacts 93*a* and 93*b*. Preferably, main output contacts 93*a* and 93*b* may be, for example, connectors for a loudspeaker or other audio output. Preferably, primary connector 66 is a conventional headphone jack and plug 92 is a corresponding headphone plug.

Preferably, a pair of op-amps 95*a* and 95*b* are electrically coupled between the outlet sides of switches 68*a* and 68*b* (that is, the side opposite inlet contacts 67*a* and 67*b*) and main output contacts 93*a* and 93*b*, respectively. In embodiments in which only one sound processing circuit output 81*a* is provided, op-amp 95*b* may be omitted, and op-amp 95*a* may be a mono op-amp.

As shown in FIG. 14, second pins 24*b* and 24*e* are electrically connected to the outputs of op-amps 82*a* and 82*b*, respectively, to receive the audio signal(s) therefrom. First pins 24*a* and 24*d* are electrically coupled to primary contacts 67*a* and 67*b* of primary connector 66. With the switches 68*a* and 68*b* of connector header 112 being in the normally closed position, second pins 24*b* and 24*e* are electrically coupled first pins 24*a* and 24*d* to provide the audio signal to primary connector 66. Third pin 24*c* is coupled to a ground 90. Alternatively, third pin 24*c* may carry another signal or indicate another condition, or be unconnected.

Wiring harness 74 includes a wiring harness plug 114 (shown in FIG. 15 and omitted from FIG. 14 for clarity) that is capable of being inserted into connector header 112 to connect to the pins therein, and includes wiring to electrically couple secondary connector 72 to header 112. The wiring of harness 74 is shown schematically and described above, and any type of connecting wires may be employed. The shape of header 112 and plug 114 are distorted in FIG. 15 for clarity.

Secondary connector 72 includes a secondary socket 95 formed therein for receiving a secondary plug 96. Typically, secondary connector 72 is provided at the front of a personal computer box, shown schematically in FIG. 15 as reference numeral 86, or similar conveniently accessible location, for easy assess thereto by a user. Thus, secondary connector 72 preferably is spaced apart from PCB 64. Preferably, secondary connector 72 is a conventional headphone jack and plug 96 is a corresponding headphone plug.

Secondary connector 72 includes a first or left input contact 77*a* and a second or right input contact 77*b* for receiving the left and right channels of the audio signal. Further, secondary connector 72 includes a first or left switch 78*a* and a second or right switch 78*b*, and a pair of output contacts 79*a* and 79*b* coupled to switches 78*a* and 78*b* opposite the input contacts 77*a* and 77*b*, respectively. Preferably, each of the switches 78*a* and 78*a* are normally closed, thereby connecting contacts 77*a* and 79*a* and contacts 77*b* and 79*b* together.

Referring particularly to FIG. 14 to describe the operation of the circuit of the present invention, as well as a method according to another aspect of the present invention, sound card system 60 is operable in a first configuration that includes circuit 62, primary connector 66, and switching connector header 112, and that omits the secondary connector. In the first configuration, the audio signal from the circuit outputs 81*a* and 81*b* passes through op-amps 82*a* and 82*b* (as well as through any second resistor additional resistors, op-amps, or components according to the particular requirements of the application, as understood by persons familiar with audio circuits in light of the present disclosure) to header second pins 24*b* and 24*e*.

Because there is no secondary connector disposed in connector header 112, header spring contacts 30*a* and 30*b* (or 52*a* and 52*b*) are in their closed position, and header first pins 24*a* and 24*d* are electrically coupled to header second pins 24*b* and 24*e* via spring contacts 30*a* and 30*b* (or 52*a* and 52*b*), respectively. While there is no plug inserted into primary connector socket 91, primary switches 68*a* and 68*b* are closed such that main output contacts 93*a* and 93*b* receive the audio signals from header first contacts 24*a* and 24*d*. Because loudspeakers (not shown) may be connected to the main output contacts 93*a* and 93*b*, respectively, the loudspeakers may audibly produce sounds that represent the audio signals.

Upon insertion of primary plug 92 into primary socket 91, left primary switch 68*a* and right primary switch 68*b* open to interrupt the circuit with respect to main output contacts 93*a* and 93*b*, respectively, thereby muting the signal at contacts 93*a* and 93*b*. Because portions of the primary plug are electrically coupled to primary contacts 67*a* and 67*b*, primary headphones (not shown) coupled to primary plug 92 receive the audio signals.

Sound card system 60 is operable in a second configuration that comprises the components of the first configuration as well as secondary connector 72. In the second configuration, wiring harness plug 74 is inserted into header 112, thereby electrically coupling secondary connector left contact 77*a* with second pin 24*b*, secondary connector right contact 77*b* with the other second pin 24*e*, secondary connector left output contact 79*a* with header first pin 24*a*, secondary connector right output contact 79*b* with the other first pin 24*d*, and a ground connection of the secondary connector with ground pin 24*c*.

Because inserting plug 114 into header 112 opens the switches formed by spring contacts 30*a* and 30*b* (or 52*a* and 52*b*), the secondary connector 72 receives the signal according to the connections described above. While there is no secondary plug inserted into secondary socket 95, the circuit operates as described with respect to the first configuration (that is, main output contacts 93*a* and 93*b* receive the audio signal) because secondary switches 78*a* and 78*b* are normally closed such that the signal from op-amps 82*a* and 82*b* passes through header second pins 24*b* and 24*e*, through secondary connector input contacts 77*a* and 77*b*, through normally closed switches 78*a* and 78*b*, through output contacts 79*a* and 79*b*, through header first pins 24*a* and 24*d*, and to the primary connector 66.

Upon insertion of secondary plug 96 into secondary socket 95, secondary switches 78*a* and 78*b* open to electrically de-couple contacts 77*a* and 79*a* and contacts 77*b* and 79*b*. Therefore, the signal to primary connector 66 is interrupted.

Co-pending U.S. patent application Ser. No. 09/594,524, entitled "Audio System With Optional Auto-switching Secondary Connector, And Method For Same," filed Jun. 14, 2000, which is incorporated herein by reference in its entirety, discloses, inter alia, circuits employing a non-switching header. The co-pending application provides general examples of various circuits and components that persons familiar with sound processing circuits will understand provide examples of circuits that may be modified to employ the switching header according to the present invention.

The specification describes the present invention by employing the illustrations herein, although the present invention is not limited to the particular embodiments described herein. Rather, the invention encompasses aspects, features, and embodiments that will be apparent to persons familiar with sound card or circuit technology in light of the present disclosure and in accordance with the appended claims. For merely one example, the present invention is illustrated with respect to a personal computer, although the present invention may be employed with virtually any device that plays sound. Further, a broad range of configurations and operations of systems that employ a switching header according to the present invention will be apparent to persons familiar with sound processing circuit technology. The invention contemplates employing the essential elements of the circuit and devices described herein as a sub-circuit or sub-system of a larger system, and therefore additional components may be included and even interspersed within the components described herein. Further, the invention is not limited to devices with left and right channels, but encompasses devices, circuits, and methods with a single channel and with multiple channels.

Also, the present invention employs headphone connectors to illustrate the present invention, although the present invention is not limited thereto. Rather, the present invention encompasses any conventional connectors, such as line in connectors, and others, as described in Co-pending application Ser. No. 09/594,524. In each of the embodiments described herein, the particular characteristics of the op-amps and resistors will be chosen according to engineering and circuit design principles understood by persons familiar with such technology.

We claim:

1. A dual-configuration sound card system for processing an audio signal, said sound card system being operable in each one of a first configuration and a second configuration, wherein:

said first configuration comprises:

a printed circuit board having a sound source mounted thereon for providing an audio signal;

a primary connector including a primary socket coupled to the printed circuit board; and a connector header having plural contacts and a header switch therein, said connector header being coupled to the printed circuit board and in electrical communication with each one of the sound source and said primary connector, said header switch being closed to enable the audio signal to pass therethrough to said primary connector; and said second configuration comprises said printed circuit board, said connector header, and said primary connector, and further comprises:

a secondary connector including a secondary socket being spaced apart from said printed circuit board for removably receiving a secondary plug; and a wiring harness having a wiring harness plug that is insertable into said header switch, said header switch opening in response to insertion of said harness plug into said connector header to disconnect said sound source with said primary connector within said connector header, said wiring harness electrically coupling said secondary connector to said connector header such that the secondary connector receives the audio signal.

2. The dual-configuration sound card system of claim 1 wherein said secondary connector includes a secondary connector switch that electrically couples the sound source to the primary connector in said second configuration.

3. The dual configuration sound card system of claim 2 wherein the sound card switch opens in response to insertion of the secondary plug into said secondary connector to disconnect said sound source from said primary connector.

4. The dual-configuration sound card system of claim 1 further comprising a main output contact disposed on the printed circuit board, the sound source producing the audio signal to the main output contact via the primary connector.

5. The dual-configuration sound card system of claim 4 wherein said primary connector includes a switch that opens to mute the audio signal to the main output contact in response to insertion of a primary plug into said primary connector socket.

6. The dual-configuration sound card system of claim 1 wherein said plural header contacts include a first contact electrically coupled to said sound source to be in communication with the audio signal and a second contact electrically coupled to said primary connector circuit, said header switch being disposed between said header first contact and said header second contact, said header switch being closed between said header first contact and said second contact while the sound card system is in the first configuration to enable the audio signal to pass between said sound source and said primary connector, said header switch being a first header switch opening between said first contact and said second contact in response to inserting said wiring harness plug into said connector header, thereby accomplishing the disconnection of said sound source with said primary connector.

7. The dual-configuration sound card system of claim 6 wherein said plural header contacts further include a third contact electrically coupled to the sound source, a fourth contact electrically coupled to said primary connector circuit, and a second header switch disposed between said header third contact and said header fourth contact, said second header switch being closed between said header third contact and said fourth contact while the sound card system is in the first configuration to enable the audio signal to pass to said primary connector, said second header switch opening between said third contact and said fourth contact in response to inserting said wiring harness plug into said connector header to mute at least a portion of the audio signal at said primary connector.

8. The dual-configuration sound card system of claim 7 wherein said header first and second contacts and said first header switch form a portion of a right audio channel and said header third and fourth contacts and said second header switch form a portion of a left audio channel.

9. The dual-configuration sound card system of claim 6 wherein each one of said sound source, said primary connector, and said connector header are mechanically affixed to a printed circuit board and the secondary connector is spaced apart from the printed circuit board.

10. The dual-configuration sound card system of claim 9 wherein said sound source is a sound processing circuit.

11. The dual configuration sound card system of claim 9 wherein said sound source is a connector on the printed circuit board for receiving the audio signal from a circuit that is spaced apart from the printed circuit board, whereby the sound source connector provides the audio signal that is generated off the sound card.

12. The dual-configuration sound card system of claim 9 wherein said primary connector is a rear headphone connector disposed proximate a rear of a computer and said secondary connector is a front headphone connector disposed proximate a front of the computer.

13. The dual-configuration sound card system of claim 12 further comprising a first op-amp electrically coupled between the output of the sound source and said first header contact in series.

14. The dual-configuration sound card system of claim 9 wherein said primary connector is a rear microphone connector disposed proximate a rear of a computer and said secondary connector is a front microphone connector disposed proximate a front of the computer, said sound source capable of receiving the audio signal from at least one of the rear microphone connector and said front microphone connector thereby providing the audio signal to a main output contact disposed on the printed circuit board.

15. The dual-configuration sound card system of claim 9 wherein said primary connector is a line input connector and said secondary connector is another line input connector, said sound source capable of receiving the audio signal from at least one of. the line input connectors thereby providing the audio signal to a main output contact disposed on the printed circuit board.

16. A dual-configuration sound card for processing an audio signal, said sound card system comprising:

a printed circuit board having a sound processing circuit mounted thereon, said sound processing circuit in communication with the audio signal;

a primary connector including a primary socket coupled to the printed circuit board; and a connector header including plural contacts and a header switch, said connector header being coupled to the printed circuit board and in electrical communication with each one of the sound processing circuit and said primary connector, said header switch being closed in a first configuration to enable the audio signal to pass therethrough to said primary connector, said header switch being open in a second configuration to interrupt the audio signal to the primary connector.

17. The dual-configuration sound card of claim 16 wherein said header plural contacts include a first contact in electrical communication with said sound processing circuit and a second contact in electrical communication with said primary connector, said header switch connecting said first contact with said second contact to enable the audio signal to pass therethrough in the first configuration, said switch opening between said first contact and said second contact to interrupt the audio signal therebetween in the second configuration.

18. The dual-configuration sound card of claim 17 wherein said primary connector is a headphone connector and the sound processing circuit provides the audio signal to the headphone connector.

19. The dual-configuration sound card of claim 17 wherein said primary connector is a microphone connector and the sound processing circuit receives the audio signal from the microphone connector.

20. The dual-configuration sound card of claim 17 wherein said primary connector is a line input connector and the sound processing circuit receives the audio signal from the line input connector.

21. The dual-configuration sound card of claim 17 wherein said switch opens between said first contact and said second contact in response to insertion of a secondary plug into said connector header.

* * * * *

UNITED STATES PATENT AND TRADEMARK OFFICE

CERTIFICATE OF CORRECTION

PATENT NO. : 6,491,533 B2 
DATED : December 10, 2002
INVENTOR(S) : Thomas M. Costello et al.

Figure 1:
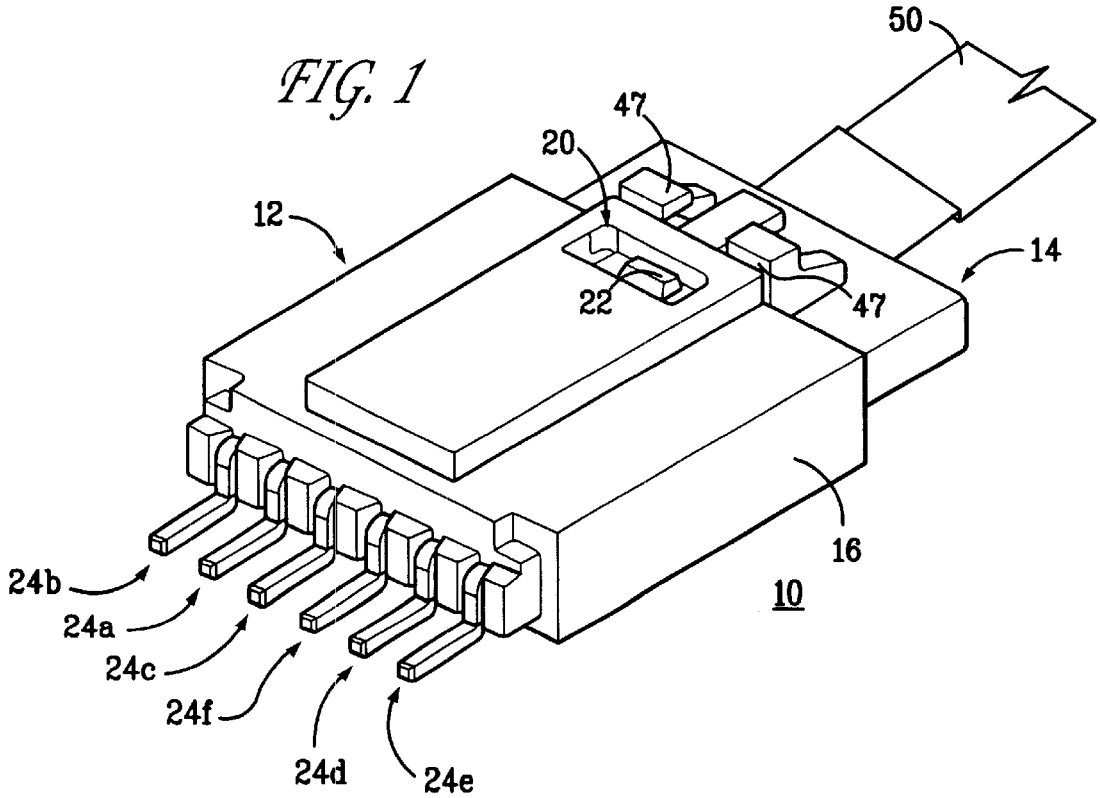
FIG. 1 is a perspective view of a header assembly according to an aspect of the present invention.
Figure 2B:
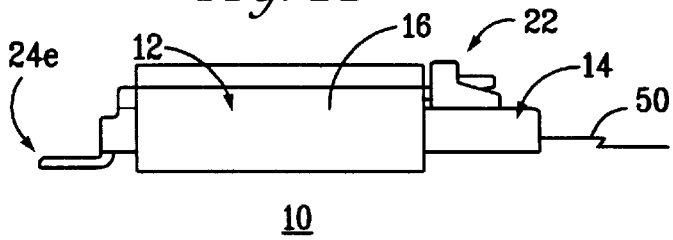
FIG. 2B is a side view of the header assembly shown in FIG. 1.
Figure 2A:
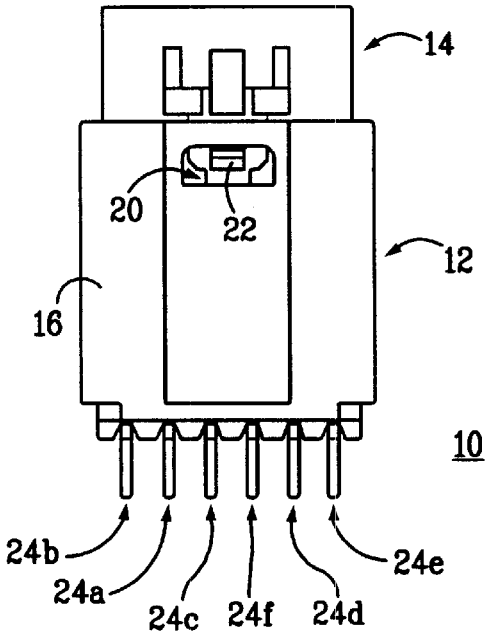
FIG. 2A is a top view of the header assembly shown in FIG. 1.
Figure 2C:
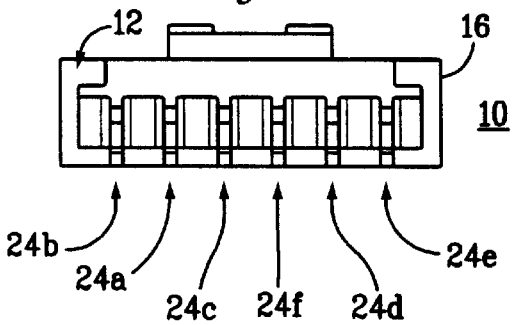
FIG. 2C is an end view of the header assembly shown in FIG. 1.

It is certified that error appears in the above-identified patent and that said Letters Patent is hereby corrected as shown below:

Column 4,
Line 49, "FIG. 1" should read -- FIG. 11 --.

Signed and Sealed this

Twenty-sixth Day of August, 2003

JAMES E. ROGAN
*Director of the United States Patent and Trademark Office*